United States Patent [19]

Droguet

[11] Patent Number: 5,014,847

[45] Date of Patent: May 14, 1991

[54] CONTAINER-DISPLAY UNIT FOR ARTICLES HANGING FROM RODS

[75] Inventor: Roland Droguet, Paris, France

[73] Assignee: Societe Anonyme dite: Droguet International, Paris, France

[21] Appl. No.: 383,405

[22] Filed: Jul. 24, 1989

[30] Foreign Application Priority Data

Jul. 28, 1988 [FR] France ..... 88 10181

[51] Int. Cl.[5] ..... B65B 85/18; A47F 7/19

[52] U.S. Cl. ..... 206/279; 206/280; 206/298; 229/23 C

[58] Field of Search ..... 206/291, 290, 289, 279, 206/280, 284, 298, 386; 229/23 C; 211/59.1

[56] References Cited

U.S. PATENT DOCUMENTS

| | | | |
|---|---|---|---|
| 2,770,357 | 11/1956 | Sheard | 206/291 |
| 3,096,923 | 7/1963 | Piller . | |
| 3,602,159 | 8/1971 | Marschak | 211/153 |
| 4,091,923 | 5/1978 | Collins | 206/386 |
| 4,516,681 | 5/1985 | Jahel | 211/59.1 |
| 4,576,280 | 3/1986 | Dove et al. . | |
| 4,671,417 | 6/1987 | O'Brien . | |
| 4,832,298 | 5/1989 | Metcalf | 211/59.1 |

FOREIGN PATENT DOCUMENTS

| | | | |
|---|---|---|---|
| 1551154 | 11/1967 | France | 211/59.1 |
| 2575731 | 7/1986 | France . | |
| 581958 | 9/1958 | Italy | 206/291 |
| 381567 | 3/1932 | United Kingdom . | |
| 467212 | 6/1937 | United Kingdom . | |

*Primary Examiner*—Paul T. Sewell
*Assistant Examiner*—Jacob K. Ackun, Jr.
*Attorney, Agent, or Firm*—Stevens, Davis, Miller & Mosher

[57] ABSTRACT

The invention relates to a parallelepipedic container comprising a bottom and a plurality of cardboard walls made of cardboard, any two consecutive walls defining a dihedron, and means arranged to support several rods (66) furnished with articles (76), by one of the ends of the said rods.

According to the invention, the said support means comprise two main uprights (64,65) made of wood arranged in two consecutive dihedrons of the container and resting on the said bottom, each upright being fixed to the dihedron, and support means (20,91,97) extending transversely between the two main uprights, and having two ends by which they are fixed respectively thereto, the said rods being fixed to the said transverse support means (20,91,97).

Application to the manufacture of container-display units for department stores.

8 Claims, 5 Drawing Sheets

CONTAINER-DISPLAY UNIT FOR ARTICLES HANGING FROM RODS

The invention relates to a parallelepipedic container comprising a bottom and a plurality of cardboard walls, with any two adjacent walls defining a dihedron, and means arranged to support several rods furnished with articles, by one end of the said rods.

A container of this kind is known from French Pat. No. 2 575 731 in the name of the Applicant. It is only designed for the storage or the transport of suspended articles. Bars are provided to support the free ends of the rods, during transport but also during storage. The main means for supporting the rods are constituted by wooden strips bonded to a wall of the container, and extending transversely between two dihedrons.

This container gives satisfaction. However, the strips have been found to undergo deformation in the case of heavy articles, as well as becoming unbonded.

Furthermore, attempts are constantly being made with a view to further simplifying the operations involved in stocking the shelves of large stores. Now, the use of the aforementioned container presupposes that each of the rods furnished with articles be removed in order to be fastened onto a support provided in the shelves of the store. It would be desirable to simplify such an operation.

The invention thus aims to provide a container which, on one hand, better withstands mechanical stresses and, on the other hand, permits a simplification of the shelf stocking operations.

According to the invention, the said rod supporting means comprise two main wooden uprights disposed in two consecutive dihedrons of the container and resting on the said bottom, each upright being fixed to the adjacent dihedron; and support means extending transversely between the two main uprights, and having two ends by which they are fixed respectively on the latter, the said rods being fixed on the said transverse support means.

According to a first form of embodiment, the said transverse support means include at least one load bar, each main upright having a mortice in which is accommodated one end of the load bar.

According to a second form of embodiment, the said transverse support means include a load grid or plate, each main upright having a groove in which is accommodated one side of the load plate or grid.

According to a variant on the preceding form of embodiment, the container includes a wooden auxiliary upright fixed to a wall of the container extending between the said main uprights, the said auxiliary upright extending parallel to the main uprightrs, the transverse support means including at least one load grid or plate extending between the auxiliary upright and each of the main uprights and fixed in a slot provided therein.

If necessary, the container includes means for supporting the free end of each rod, fixed in the vicinity of the dihedrons opposite the said main uprights.

In the event of the container being intended to support articles extending over a major part of its height, the means for supporting the free ends of the rods include an auxiliary bar extending parallel to the said load bar between two walls, as well as two hooks having a portion arranged to overlap the upper edges of the said walls in the vicinity of the dihedrons, and a portion spaced apart from the wall comprising a cutout arranged so as to be traversed by one end of the said auxiliary bar.

In the event of the container being intended to support small sized articles, the said means for supporting the free end of each rod include two wooden auxiliary uprights disposed in the vicinity of the dihedrons and fixed on them, as well as several superposed auxiliary bars, fixed in the auxiliary uprights.

Advantageously, the container includes a pre-indented line delimiting an upper portion located on the free end side of the rods.

Advantageously, the container includes a wooden pallet, nailed or stapled onto the outer face of the said bottom.

As a supplement, the container can include two diagonal wooden support strips extending respectively between the upper ends of the main uprights and the bottom.

Further details and advantages of the invention will become apparent in the course of the following description of a number of preferred forms of embodiment, with reference to the annexed drawings wherein.

Figure 1:
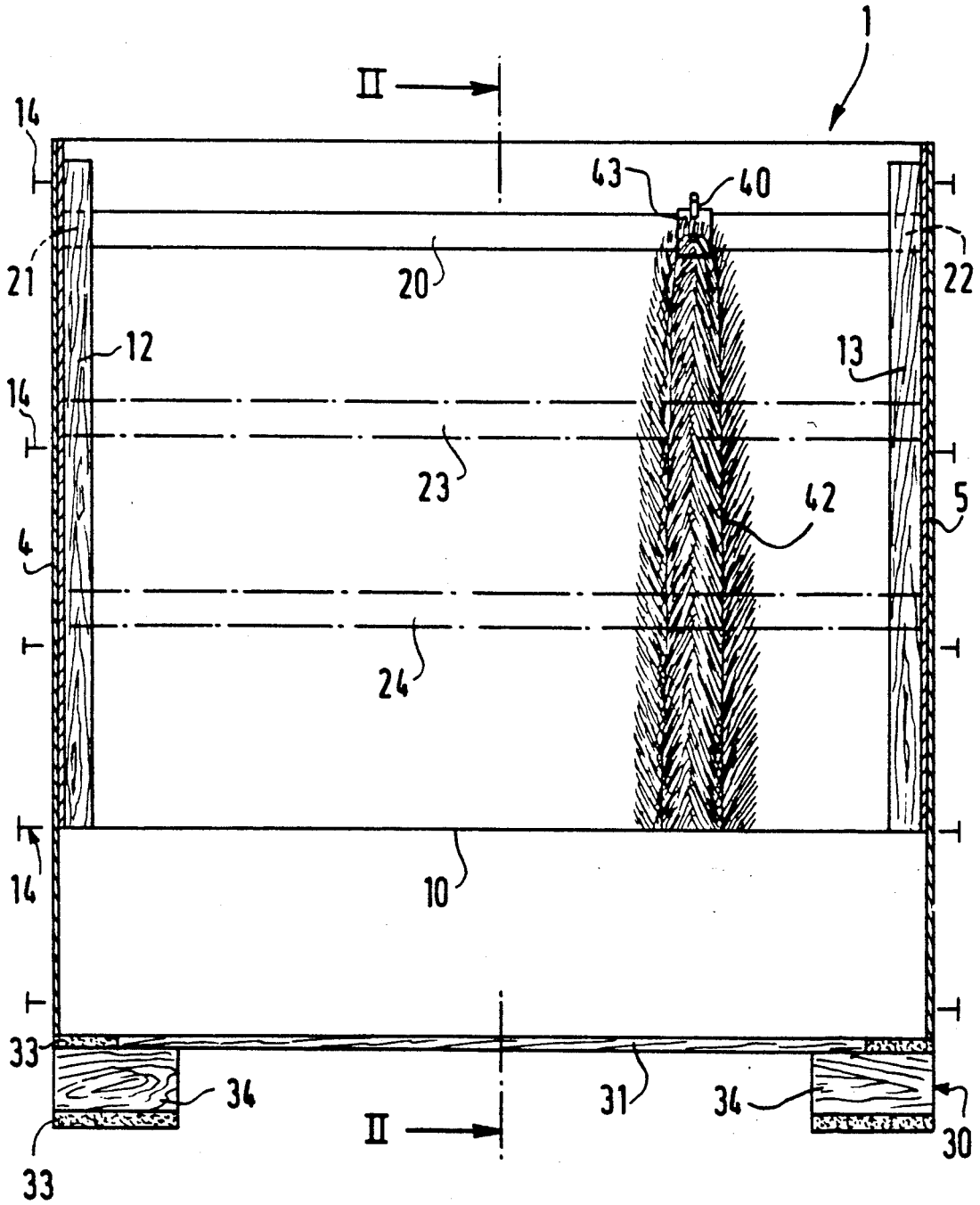
FIG. 1 is a front elevation view of a container according to the invention, including a single load bar for long products.
Figure 2:
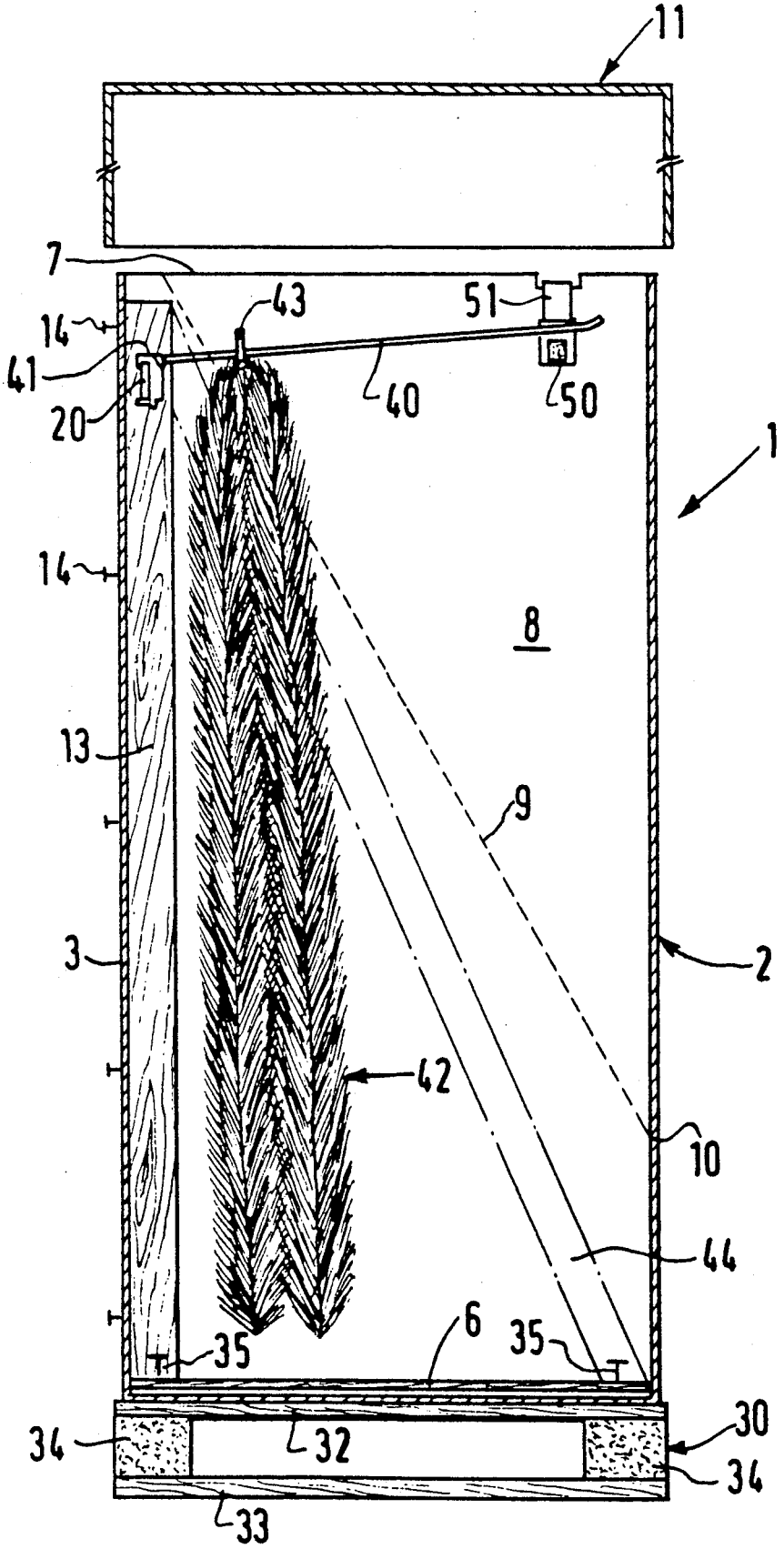
FIG. 2 is a side view, in cross-section along line II—II of FIG. 1.

Container 1, represented in FIGS. 1 and 2, is a right-angled parallepiped comprising a front face 2, a rear face 3, two side faces 4, 5 and a bottom 6, an opening 7 having dimensions equal to those of bottom 6 being provided in its upper portion.

The container 1 is made of cardboard, in particular standardized BC 50 type double-face corrugated cardboard. It has a front upper portion 8 pre-indented on the side faces along a slanting line 9, and on the front face along a line 10 parallel to the bottom 6. Pre-indented portion 8 has been removed in FIG. 1. Furthermore, a parallelepipedic cover 11 is provided to cap the upper portion of the container.

Two wooden uprights 12, 13 having a rectangular cross-section are disposed respectively in the two dihedrons defined by the intersection of rear face 3 and the two side faces 4, 5. These uprights rest on the bottom 6 and the side and rear faces, and extend over almost the entire height of the container. In this example, each upright has a cross-section measuring 25×55 mm and its widest face bears against a side face of the container.

Each upright is fixed in the container by a plurality of nails 14 especially designed for wood-cardboard assembly purposes. Each nail has for this purpose a large flat head having a diameter, for example, of approximately 10 mm. These nails 14 are driven in from outside the container, along the two faces of the uprights in contact with the container.

Additionally, and depending on the suspended loads, the uprights can also be bonded to the cardboard.

In FIGS. 1 and 2, the uprights 12, 13 support a hollow metal load bar 20 having a rectangular cross-section which extends over the entire length of the container, its large face being parallel to the rear face 3 of the container. Each upright 12, 13 has in its upper portion a mortice 21, 22 with a cross-section corresponding to that of the load bar 20, which passes transversely through the upright, and in which an end of the load bar is accommodated, before the uprights are nailed.

It is advantageous to choose a load bar of standard dimensions. In the present case, its width is equal to 40 mm and its thickness to 10 mm.

Each upright can comprise other mortices, spaced out below the first, to accommodate other load bars 23, 24.

The container is equipped with a wooden pallet 30 formed by a rectangular frame having the dimensions of the bottom 6 of the container. Pallet 30 comprise two long sides each constituted by a board 31 and two short sides each constituted by two spaced boards 32, 33. The different boards are assembled to one another by means of four cube-shaped blocks 34 placed in the corners of pallet 30.

The pallet is nailed onto the outer side of the bottom 6 of the container, by means nails 35 identical with the aforementioned nails 14, which are driven into blocks 34 from inside the container.

A plurality of metal rods 40 are attached to the load bar 20 by means of hooks 41 arranged to straddle the load bar. If the load bar is of standard dimensions, use can advantageously be made of commercially available rods and hooks.

Although permanent attachment of the rods to the load bar can be contemplated, it is preferable to adopt the swifter, modifiable solution described above in which use is made of hooks that simply straddle the load bar and are held thereon by the weight of the rods and items attached thereto.

The means for supporting the rods 40 illustrated in FIGS. 1 and 2 are particularly suitable for cases in which heavy articles are suspended from the rods.

This example relates to decorative garlands 42 folded in two and attached to rods 40 by means of cardboard label-hooks.

Figure 5:
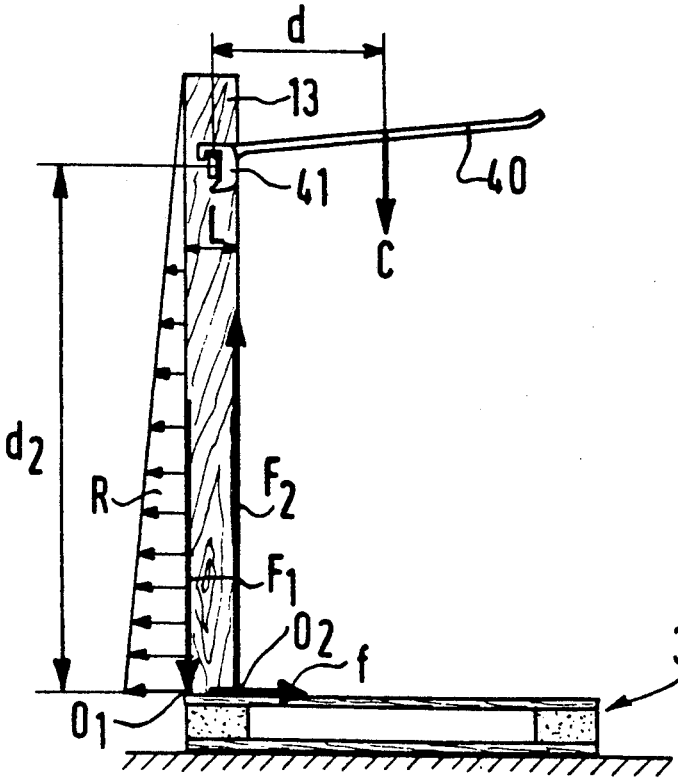
FIG. 5 is a schematic side elevation view showing the distribution of the stresses withstood by the container.

FIG. 5 illustrates the way in which uprights 12, 13 considerably limit the stresses applied to the cardboard structure. Load C represents the total load of the articles suspended along the different juxtaposed rods 40, applied to the centre of gravity at a distance d from the longitudinal axis of the load bar.

If no account is taken of the bending strength of the two rear dihedrons of the container and the assembly formed by the two uprights 12, 13, the rods 40 and the hooks 41 is isolated, the following equations can be obtained for the static moments:

$$-\text{moment at } O_1\text{: } C\times(d+L/2)=F_2\times$$

the uprights having cross-sectional dimensions L×1. By way of example, for a load of 30 daN on the load bar, we obtain for L=50 mm:

$$30\times0.275=F_2\times0.05$$

i.e. $F_2=165$ daN $$-\text{moment at } O_2\text{: } C\times(d-L/2)=F_1\times1$$

i.e. $30\times0.225=F_1\times0.05$ i.e. $F_1=135$ daN

Taking this simplified hypothesis, each uprright is subjected at $O_2$ to a compression stress of 82.5 daN and, at $O_1$, to a tensile stress of 67.5 daN.

The compression stress, if l=25 mm, induces a wood to wood pressure of 82.5: $(2.5\times1)=33$ daN/cm$^2$, which is perfectly acceptable.

The tensile stress is transmitted directly to the cardboard dihedrons. Considering that each face of the dihedron cooperates only over a width of 10 cm, this tensile stress induces a tearing stress of: 67.5 daN: 20 cm≈3.4 daN/cm, which is well below the tearing strength of BC 50 type cardboard in the direction of the corrugations, which is greater than 30 daN/cm. For this tension, the shearing value of the assembly is: 67.5 daN: 100 (5+2.5)=0.09 daN/cm$^2$, which is very small.

These calculations show that the cross-section L×l of the wooden uprights and the type of cardboard used should be determined in accordance with load C. In particular:

- forces $F_1$ and $F_2$ are reduced by increasing the dimension L of the uprights;
- the wood to wood pressure at $O_2$ is reduced by increasing the dimension l of the uprights;
- the value of force $F_1$ can be used to determine the quality of the cardboard to be used;
- the shearing value determines the use of complementary bonding.

More precise study should bring in the bending strength R of the two rear dihedrons which contribute to stabilising the torque created by load C. This strength, which is represented as distributed along the uprights in FIG. 5, reduces forces $F_1$ and $F_2$ and introduces a horizontal force f which is very easily taken up by nailing the cardboard to the wooden pallet 30. The tearing stress applied to the cardboard is not appreciably modified.

When the container in FIGS. 1 and 2 is installed at a place of sale, its front upper portion 8 being removed, uprights 12, 13 suffice to support durably the rods 40 furnished with heavy articles.

Figure 3:
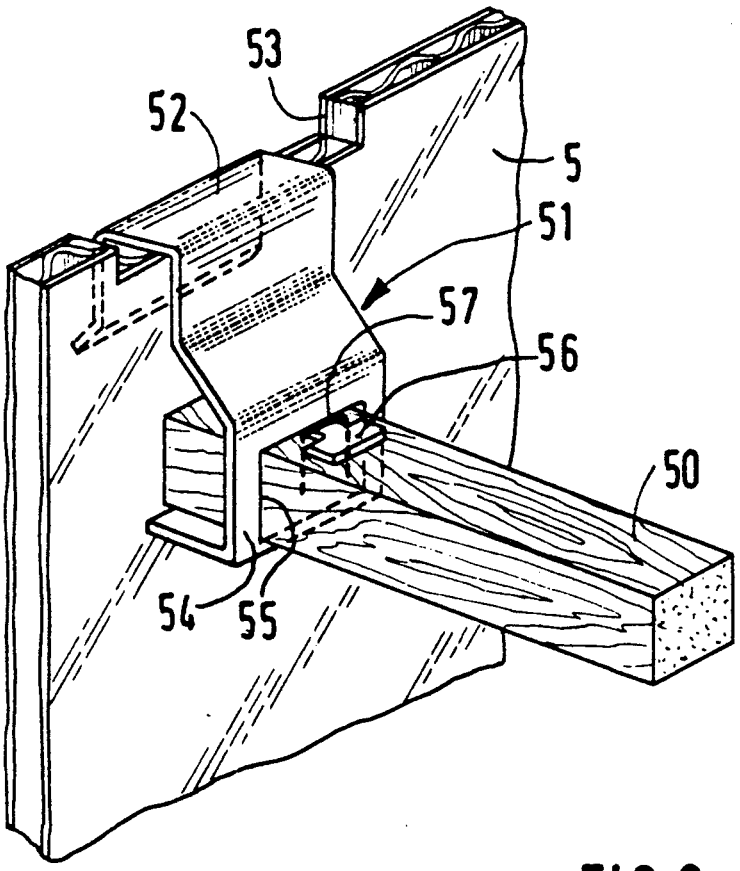
FIG. 3 is an enlarged perspective view showing a detail of FIG. 2.

While the filled container is being transported to a place of sale, or during its storage, it is preferable to support the rods in the vicinity of their free ends in order to provide relief for the container, particularly with regard to dynamic stresses resulting from its displacement. For this purpose, there is provided a wooden support strip 50 extending over the entire length of the container, and each end of which is supported by a hook 51. Each hook 51 comprises (FIG. 3) a portion 52 having a U-shaped cross-section arranged so as to straddle a side face 5 of the container in a U-shaped cutout 53 provided in the side face. This hook 51 includes another, L-shaped, portion 54 having a cutout 55 spaced apart from the side face of the container and arranged to receive one end of support strip 50. Preferably, there extends from the upper edge of cutout 55 a T-shaped portion 56 arranged to run along the support strip 50, and a staple 57 straddles T-shaped portion 56 and penetrates support strip 50: hook 51 is thus fixed to support strip 50 in such a way that there is no risk of its falling while the container is being handled and that it stiffens the front face of the latter. It will be noted that each hook 51 bears on a portion of the side face of the container that is adjacent to the dihedrons in order to transmit thereto the load sustained in supporting rods 40.

Figure 4:
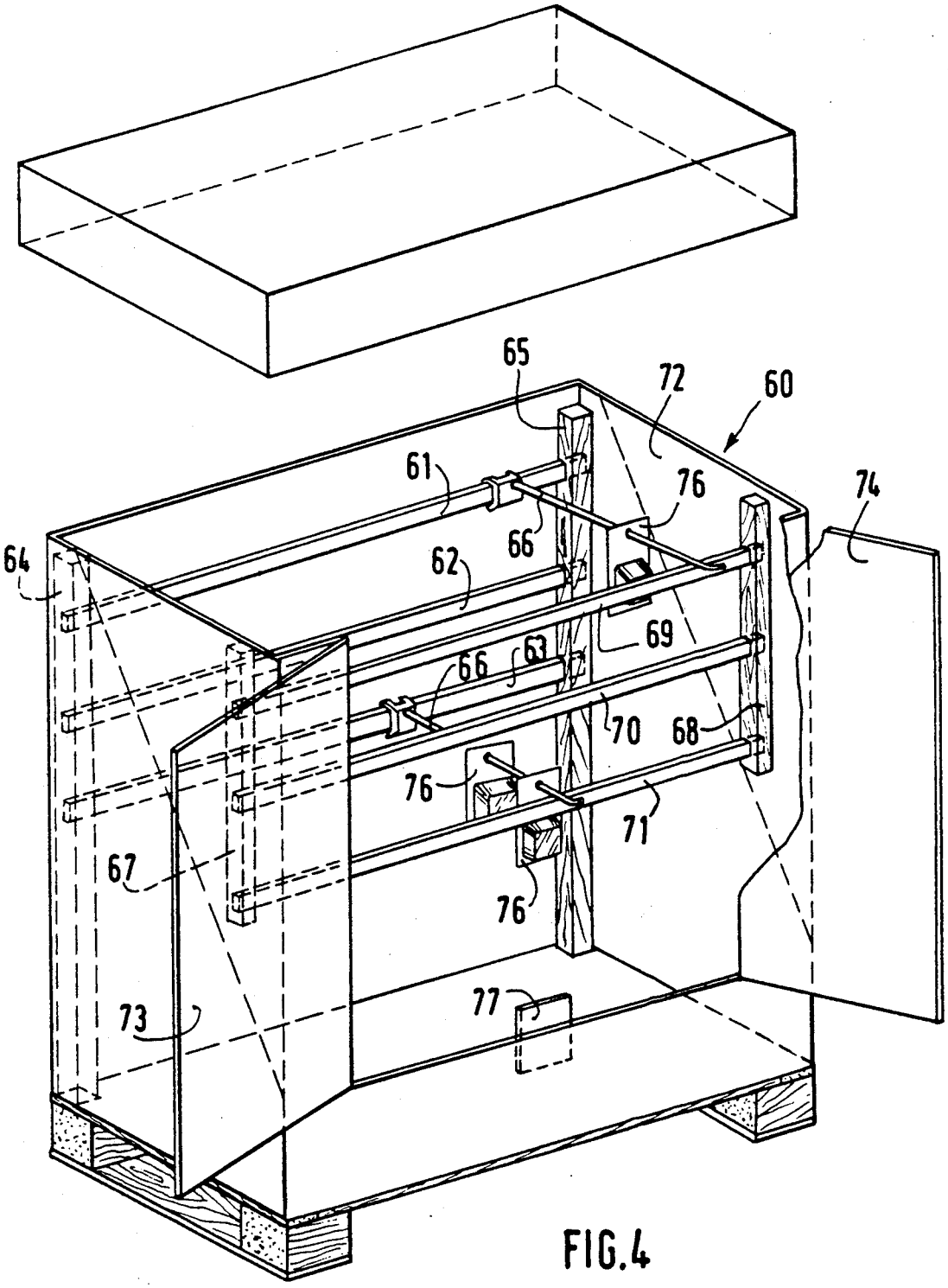
FIG. 4 is a perspective view of another container according to the invention.

FIG. 4 illustrates a variant embodiment in which the container 60 comprises several load bars 61 to 63 superposed and supported by two uprights, 64, 65, each load bar supporting several rods 66. This container is designed to support small-sized articles 76, generally taking the form of blister packs. In the case of light articles, it is not necessary to suport the free ends of rods 66 by means of support strips during transport and storage. In the case of heavy articles, two auxiliary uprights, 67, 68, can be added to side faces of the container, these uprights being provided with mortices to receive superposed auxiliary bars 69 to 71.

The auxiliary uprights and bars are made of wood, the uprights being nailed onto the upper front pre-indented portion 72 of the container, in the vicinity of the dihedrons. The said portion comprises, on the front face of the container, two doors, 73, 74, through which the rods 66 furnished with articles can be placed in the container. Preferably, a piece of cardboard 77 is bonded to the front face of the container so as to form a stop for doors 73, 74.

Should the container have to support extremely heavy articles, it is possible to stiffen its side faces 4, 5 by nailing, from the inside of each of them, a diagonal wooden strip 44 extending between the upper end of the adjacent upright 12, 13 and block 34 of the pallet adjacent to the front face 2 of the container, as represented in dot-and-dash lines in FIG. 2.

The main advantages of the invention are set forth below. The rod supporting means are disposed solely in the vicinity of the dihedrons of the container, that is to say at those points where the cardboard structure has the greatest rigidity. The use of wood as the constituent of the uprights makes it possible, on one hand, to fix the uprights simply by nailing them to the cardboard and, on the other hand, to use metal load bars that are substantially more rigid than wooden support strips, these bars being easily fixed to the uprights using various means. The wooden uprights thus form an original interface between the cardboard and the metal.

The wooden pallet contributes to stiffening the container and, through its blocks, efficiently supports the weight of the filled container. It permits easy handling of the container by means of a fork lift truck or pallet transporter.

Once the container has been despatched to the place of sale, its pre-indented upper front portion is removed: it then forms a ready furnished display unit. It can be placed on the lower platforms of store gondolas, at the head of the gondola or in the vicinity of the cashdesks more especially for seasonal sales. This obviates any transfer of the articles one by one, or the transfer of rods furnished with articles, to a permanent display unit installed at the place of sale.

The internal arrangements of the container according to the invention are similar in every way to the devices that constitute the said display units.

Furthermore, customers can be provided with additional information concerning the products on sale printed on the outside of the cardboard, which cannot be done in the case of the store gondalas.

Advantageously, these container-display units are despatched two by two, with the front faces opposite each other, the whole being film packed, thus ensuring:

natural protection of the doors and pre-indented portions;

protection of the colour printing on the display unit;

an advantageous international packing format of $1.2 \times 1.2 \times 1.2$ m.

Figure 6:
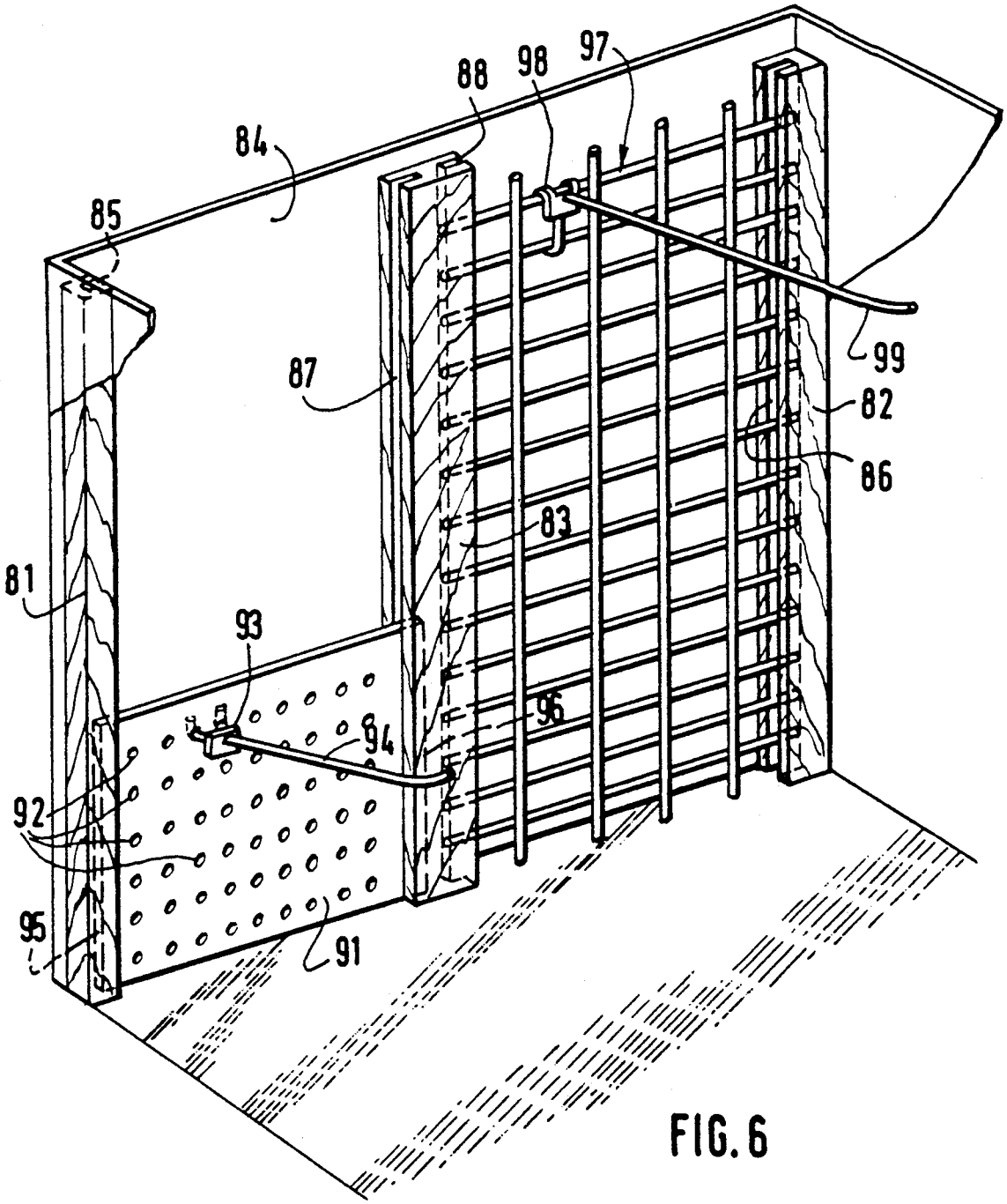
FIG. 6 is a partial perspective view of another container according to the invention.

According to the variant in FIG. 6, the container has two main uprights 81, 82 fixed in two consecutive dihedrons thereof and an auxiliary upright 83 fixed between the two main uprights on the rear face 84 of the container.

In this example, the auxiliary upright 83 extends, like the main uprights, over practically the entire height of the container.

The uprights are fixed to the container as described previously.

The main uprights 81, 82 have, on a face turned towards the auxiliary upright 83, a groove 85, 86 extending over the entire height of the upright. On the two faces of auxiliary upright 83 turned towards main uprights 81, 82 is provided a groove 87, 88 extending over the entire height of the upright.

Between the main upright 81 and the auxiliary upright 83 there extends, over a portion only of their height, a pierced load plate 91, in particular of metal. This plate, which is known per se, comprises a large number of holes 92 designed to receive hooks 93 supporting rods 94. Two side edges 95, 96 of plate 91 extend along grooves 85, 88 in the two uprights.

Plate 91 equipped with several rods on which are hooked several articles is thus firmly maintained by the main upright 81 and the auxiliary upright 83. Advantageously, plate 91 thus equipped can be removed from the container simply by sliding it vertically and can be fixed to a display unit support at a place of sale.

Between the auxiliary upright 83 and the other main upright 82 extends a load grid 97, in particular a metal one, known per se and arranged to receive hooks 98 supporting rods 99. In this example, the rod 97 extends over pratically the entire height of the uprights. Like plate 91, it extends via two side edges through grooves 86, 88 in the two uprights.

Alternatively, no auxiliary upright is provided between the main uprights; a plate or a grid extends from one main upright to the other main upright.

I claim:

1. Parallelepipedic display-container comprising:

a rectangular bottom wall made of cardboard delimited by four edges;

a front wall facing a rear wall and two side walls facing each other, each of said walls being made of cardboard and extending perpendicularly to said bottom wall from and along one of said bottom wall edges respectively;

four corners, each defined by an intersection of any of said front, rear and side walls with an adjacent one, each corner extending along said walls;

two wooden main uprights, each having several faces two of which define an angle, each main upright being disposed in one of two corners between said rear wall and said side walls so that said angle faces said corner and that said faces of the main upright defining said angle bear on said rear wall and side wall respectively and are fixed thereto all along said main upright, each main upright resting on said bottom wall;

main support means extending transversely between said two main uprights and having two ends each end of which is fixed to an upright;

several rods, each having a first end fixed to said main support means so as to extend substantially perpendicular to said rear wall, and a second free end so that several articles may be hung one behind the other on said rod, said front wall of the display-container being foldable or removable to give access to said articles.

2. The display-container according to claim 1, in which said main support means include at least one load bar having two opposite ends, a mortice extending transversely in each main upright from one face thereof and having dimensions adapted to house one end of said load bar so as to secure the latter against rotation about a longitudinal axis thereof.

3. The display-container according to claim 1, wherein said main support means include a load plate or a load grid extending in front of said rear wall on a substantial part of a height thereof, each main upright having a groove extending along a face thereof facing the other main upright, said load plate or load grid having two opposite edges housed in said grooves.

4. The display-container according to claim 1, including a wooden auxiliary upright having several faces, one of which is fixed to said rear wall all along thereof between said main uprights and parallel thereto, at least one other face of the auxiliary upright facing a first main upright and an opposite face of said main upright having a groove extending along thereof, a load grid or load plate extending in front of said rear wall on a substantial part of a height thereof and having two opposite edges housed in said grooves.

5. The display-container according to claim 1, including a removable auxiliary support means (50, 51) to support said free end of said rods during transport or storage, said auxiliary support means being fixed on said side walls in the vicinity of two corners disposed between said side walls and said front wall.

6. The display-container according to claim 5, wherein said auxiliary support means comprise: wherein said auxiliary support means comprise:

an auxiliary bar (50) extending parallel to said main support means; and two hooks (50) having a portion (52) arranged to straddle two upper edges of said side walls and a portion (54) spaced apart from the side wall, comprising a cutout (55) arranged to be traversed by one end of the said auxiliary bar (50).

7. The display-container according to claim 5, wherein said auxiliary support means comprise:

two wooden auxiliary uprights (67, 68) each having two opposite faces, one face facing a side wall and being fixed thereto all along said auxiliary upright and another face having several mortices disposed along and extending transversely in said auxiliary upright;

several superposed auxiliary bars (69, 71) extending parallel to said main support means each bar having two opposite ends, each mortice being adapted to house one end of one of said auxiliary bars.

8. The display-container according to claim 1, including a removable part comprising an upper portion of said front wall and upper portions of said side walls, said upper portion of said front wall and said upper portions of said side walls being removably connected by a score line (9, 10) to the display-container.

* * * * *